United States Patent [19]

Shimada

[11] Patent Number: 4,660,901

[45] Date of Patent: Apr. 28, 1987

[54] PREFABRICATED FURNITURE

[75] Inventor: Yoshikatsu Shimada, Kiyose, Japan

[73] Assignee: Nihon Shuno System Kabushiki Kaisha, Tokyo, Japan

[21] Appl. No.: 684,075

[22] Filed: Dec. 20, 1984

[30] Foreign Application Priority Data

| | | | |
|---|---|---|---|
| Dec. 27, 1983 | [JP] | Japan | 58-244836 |
| Apr. 20, 1984 | [JP] | Japan | 59-78618 |
| Apr. 20, 1984 | [JP] | Japan | 59-78619 |
| Apr. 25, 1984 | [JP] | Japan | 59-82074 |
| May 21, 1984 | [JP] | Japan | 59-100701 |
| May 21, 1984 | [JP] | Japan | 59-100702 |
| May 28, 1984 | [JP] | Japan | 59-106668 |

[51] Int. Cl.[4] ..... F16B 12/00

[52] U.S. Cl. ..... 312/111; 312/263; 312/107; 108/111; 52/282

[58] Field of Search ..... 312/111, 107, 263, 265; 52/36, 282, 126.7; 108/107, 111

[56] References Cited

U.S. PATENT DOCUMENTS

| | | | |
|---|---|---|---|
| 3,059,983 | 10/1962 | Strom | 108/109 |
| 3,111,723 | 11/1963 | Bates | 52/36 |
| 4,162,113 | 7/1979 | Pallavicini | 312/111 |

FOREIGN PATENT DOCUMENTS

| | | | |
|---|---|---|---|
| 2229640 | 2/1973 | Fed. Rep. of Germany | 52/36 |
| 682842 | 2/1965 | Italy | 52/126.7 |

*Primary Examiner*—Kenneth J. Dorner
*Assistant Examiner*—Gerald A. Anderson
*Attorney, Agent, or Firm*—Wegner & Bretschneider

[57] ABSTRACT

A prefabricated furniture for use in a room having a floor and a ceiling, comprises a plurality of vertical panel assemblies each including at least two joint tubes and at least three panels joined by the joint tubes so as to form one vertical panel assembly, the vertical panel assemblies being vertically arranged at predetermined intervals between the floor and the ceiling, each of the joint tubes being fitted at both opposite edge portions thereof into respective grooves formed in one or two edges of the panel of the vertical panel assembly, each of the joint tubes having plural female screws formed in both sides thereof at predetermined intervals, a plurality of horizontal panel assemblies each having a horizontal board, a plurality of attachments secured to both ends of the horizontal boards for attaching the horizontal panel assembly to the vertical panel assembly by means of plural male screws which pass through the attachment and engage the female screws of the joint tubes, and a plurality of adjustors attached to both an upper end and a lower end of each of the joint tubes for adjusting the vertical panel assemblies in a vertical direction so as to fix the vertical panel assemblies between the floor and the ceiling.

13 Claims, 18 Drawing Figures

PREFABRICATED FURNITURE

BACKGROUND OF THE INVENTION

1. Field of the Invention

This invention relates to a prefabricated furniture which can be disassembled so as to be rearranged.

2. Prior Art

Various unit type or built-in type furniture have been used for arranging a room. However, such type conventional furnitures have the following defects:

(1) A built-in type furniture cannot be moved or disassembled so as to be rearranged.

(2) Many skilled workmen are required when a built-in type furniture is arranged in a room.

(3) If a unit type of furniture is used as a partition, it is difficult to prevent noise and light from passing the furniture.

OBJECTS OF THE INVENTION

An object of this invention is to provide a new type of prefabricated furniture which can be easily assembled and disassembled.

A further object of this invention is to provide a prefabricated furniture which can be fitted on a floor, wall and ceiling in a room.

Another object of this invention is to provide a prefabricated furniture which can have noise and light insulations.

DESCRIPTION OF THE PREFERRED EMBODIMENTS

Embodiment 1

FIGS. 1 to 7 show a new type of prefabricated furniture according to this invention.

A furniture 1 is arranged as a partition in a room so as to partition the room into two sections 1*a* and 1*b*. The furniture 1 is assembled but able to be easily disassembled and moved for the purpose of rearranging the room in a desired way.

The furniture 1 includes a first wardrobe 2, a group of shelves 3 and a second wardrobe 4. The furniture 1 may be rearranged so as to include any other type structures such as a chest of drawers and book shelves.

Figure 5:
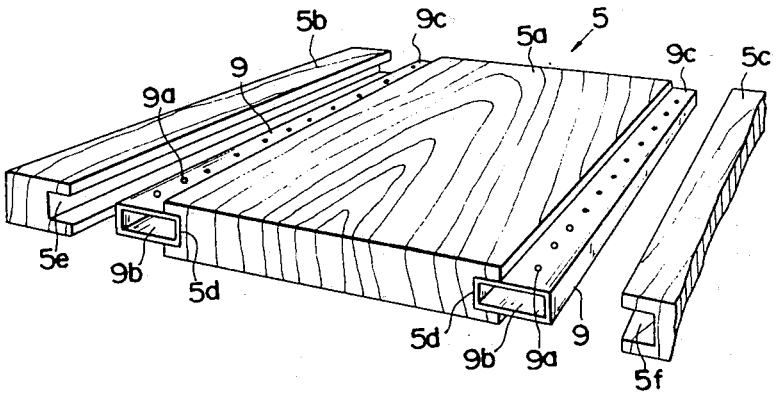
FIG. 5 is an exploded view, partly in section, of a vertical panel assembly used in the furniture shown in FIG. 1.
Figure 6:
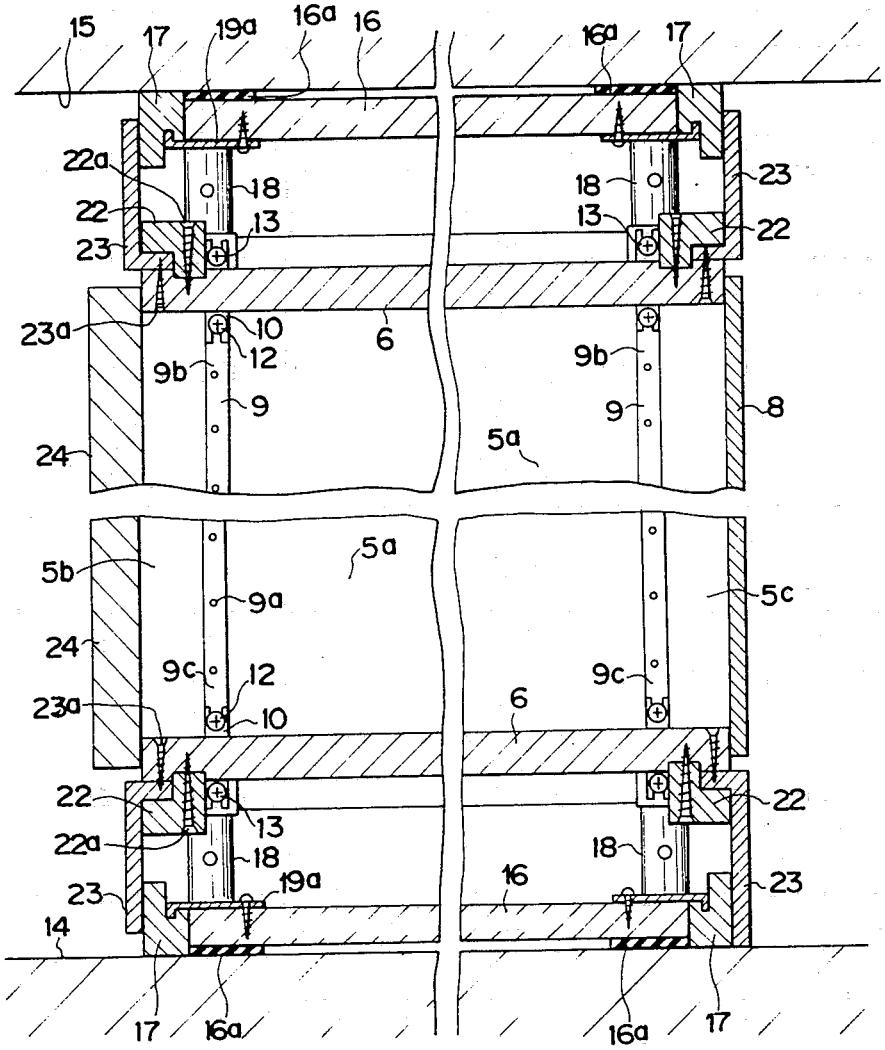
FIG. 6 shows a section taken along the line B—B of FIG. 1.
Figure 7:
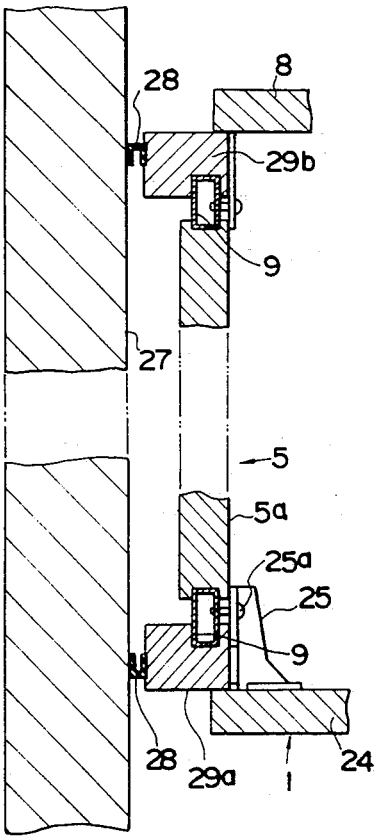
FIG. 7 is an enlarged cross-sectional view showing the vertical panel assembly of FIG. 2 and its related members.

The furniture 1 is composed of plural vertical panel assemblies 5 and plural horizontal panel assemblies 6. As best shown in FIG. 5, each vertical panel assembly 5 includes a central panel 5*a*, a front panel 5*b* and a rear panel 5*c* which are preferably made of wood or woody material. The central panel 5*a* has two grooves 5*d* in both opposite edges through its whole length. The front panel 5*b* has a groove 5*e* in its rear edge. The rear panel 5*c* has a groove 5*f* in its front edge. Those grooves 5*d*, 5*e*, 5*f* are rectangular in section. The joint tube 9 having a rectangular section corresponding to the grooves 5*d*, 5*e*, 5*f* is fitted into the grooves 5*d* and 5*e*. A joint tube 9 is also fitted into the grooves 5*d* and 5*f*. Thus, one vertical panel assembly 5 is formed as a unit. Many vertical panel assemblies 5 may be manufactured at a factory.

The joint tube 9 is preferably made of a metal such as a steel. A plurality of threaded holes or femal screws 9*a* are formed in both sides of the joint tube 9 at the same intervals through its whole length.

The horizontal panel assembly 6 is composed of plural boards each of which is made of wood or woody material. The horizontal board 6 has at each of its ends a horizontal hole 6*a* and a vertical through-hole 6*b* connected to it. A cylindrical nut 6*c* is fitted in the vertical hole 6*b*. A relatively long screw 11 extends through a hole 10*a* of an attachment 10 and the horizontal hole 6*a* of the horizontal board 6 and engages a female screw 6*d* formed in a side of the cylindrical nut 6*c* so that the attachment 10 is fixed to each end of the horizontal board 6.

The hole 10*a* is preferably positioned at an intermediate portion between the openings 10*b* and 10*c*.

A screw 13 is first set in a desired one of the female screws 9*a* at each of the four joint tubes 9. Thereafter, the horizontal board 6 is placed in such a manner that four screws 13 are inserted into the respective lower U-shaped openings 10*c* of four attachments 10. Four screws 12 are set at the four joint tubes 9 so as to pass through the upper U-shaped openings 10*b* and engage one of the female screws 9*a*.

Four lateral members 17 laterally extend in parallel on a floor 14 and a ceiling 15 at four corners of the furniture 1 across the room. The lateral members 17 may be fixed to the floor 14 and the ceiling 15 by means of several wood screws (not shown). A plurality of support members 16 are placed in parallel across the two lateral members 17 along which the vertical panel assemblies 5 are to be placed. Two rubber mats 16*a* are disposed between the support member 16 and the floor 14.

An adjustor 18 is set between a lower end 9*c* of each joint tube 9 and the support member 16 at the floor 14. Also, an adjustor 18 is set between an upper end 9*b* of each joint tube 9 and the support member 16 at the ceiling 15. The vertical panel assemblies 5 are positioned in a fixed condition by means of the adjustors 18.

Each of the adjustors 18 has a first member 19, a second member 20 and a third member 21. The first member 19 has a fitting member 19*a* and a male screw portion 19*b* fixed thereto. The male screw portion 19*b* is supported by the support member 16 and the lateral member 17 by way of the fitting member 19*a*. The fitting member 19*a* is fixed to the support member 16 by means of a wood screw. It is preferable that the rubber mats 16*a* are placed between the support member 16 and the floor 14. The second member 20 has a male portion 20*a* and a joint portion 20*b* fixed thereto. The joint portion 20*b* is fixed to the lower end 9*c* of the joint tube 9 by means of male screws 13 set in the female screws 9*a* of the joint tube 9. The lower end of the joint tube 9 is supported by an upper end portion of the male screw portion 20*a*. The male screw portion 19*b* of the first member 19 and the male screw portion 20*a* of the second member 20 engage, respectively, female screw portions 21*a* and 21*c* of the third member 21. As the two female screw portions 21*a* and 21*c* have the opposite threads to each other, the third member 21 may be turned so as to adjust a distance between the joint tube 9 and the floor 14. For such a purpose, four holes 21*b* are formed in the third member 21 so as to permit a screw driver (not shown) to be inserted into one or two of them. In another mode, the third member 21 may be formed in a hexagon shape so that it can be turned by a wrench.

Figure 1:
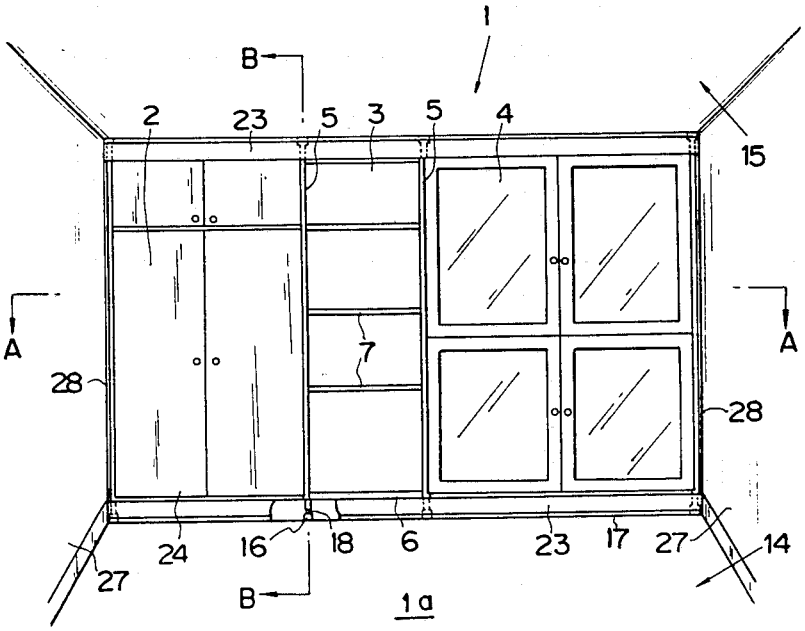
FIG. 1 is a front view of a prefabricated furniture according to a first embodiment of this invention.
Figure 2:
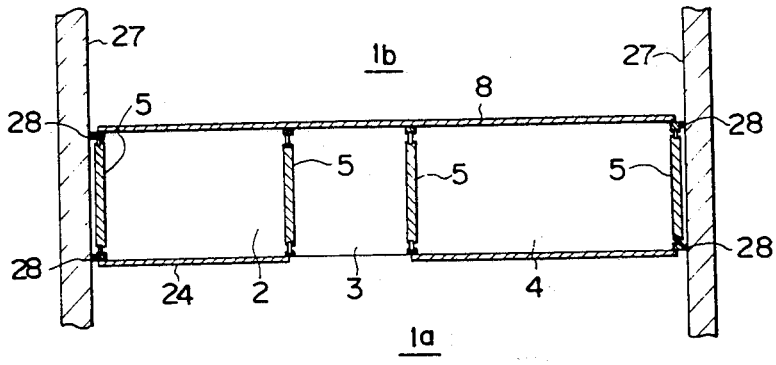
FIG. 2 shows a section taken along the line A—A of FIG. 1.

Two L-shaped members 22 are fixed to both edges of the lowest horizontal board 6 along the lateral members 17 by wood screws 22*a* for supporting decoration covers 23 which are fixed to the lowest horizontal board 6 by wood screws 23*a*. The covers 23 extend through the whole length of the furniture 1 as shown in FIG. 1.

A pair of doors 24 are attached to front edge portions of the vertical panel assemblies 5 by means of hinges 25 which are detachably fixed to the joint tubes 9 by screws 25*a*.

Four seal members 28 are placed vertically between walls 27 and the vertical panel assemblies 5 for the purpose of light and noise insulations. Such seal members 28 are made of a rubber and formed in a substantially U-shaped cross-section.

The operation of assembling the prefabricated furniture will be stated hereinafter.

First, the panels 5*a*, 5*b*, 5*c* are joined by the joint tubes 9 thereby to form the plural vertical panel assemblies 5 at a factory or in a room. The adjustors 18 are attached to the upper and lower ends 9*b*, 9*c* of the joint tubes 9.

Next, the support members 16 and the lateral members 17 are fixed on the floor 14 and the ceiling 15.

One vertical panel assembly 5 is put on the support member 16. The first member 19 of the adjustor 18 is fixed to the lateral member 17 on the floor 14. The third member 21 of the adjustor 18 at the lower end 9*c* of the joint tube 9 is turned by a screw driver or the like so as to move the vertical panel assembly 5 upwardly. Also, the third member 21 of the adjustor 18 at the upper end of the joint tube 9 is turned so as to make the second member 19 of the adjustor 18 contact the support member 16 on the ceiling 15. Thus, the vertical panel assembly 5 is fixed in position between the floor 14 and the ceiling 15.

Another vertical panel assemblies 5 are set along the support members 16 in the same manner.

The horizontal boards 16 are fixed between the adjacent vertical panel assemblies 5. For example, the screw 13 is first set in a desired one of the female screws 9*a* in each of the four joint tubes 9. Thereafter, the horizontal board 6 is placed in such a manner that the four screws 13 are inserted into the respective lower U-shaped openings 10*c* of the four attachments 10. Finally, the screw 12 is set at each of the four joint tubes 9 so as to pass through the upper U-shaped opening 10*b* and engage one of the female screws 9*a*.

The covers 23 are fixed to the horizontal boards 6 at the floor 14 and the ceiling 15. Also, the doors 24, the shelves 7, a back plate 8 and other accessories are attached to the vertical panel assemblies 5 so as to form a desired furniture 1.

The back plate 8 functions as a partition wall for the section 1*b*.

In disassembling the furniture, the covers 23, the back plate 8, the doors 24 and other accessaries are removed. The horizontal boards 6 are disjoined. The vertical panel assemblies 5 are removed from the floor 14 and the ceiling 15. Finally, the lateral members 17 and the support members 16 are removed.

Embodiment 2

Figure 8:
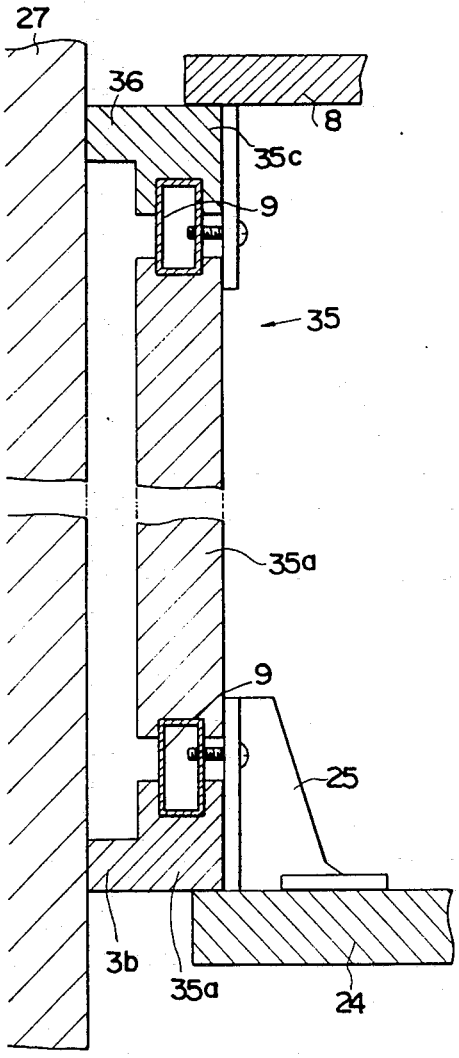
FIG. 8 is a cross-sectional view, with parts broken away for clarity, according to a second embodiment of this invention, corresponding to FIG. 7.
Figure 9:
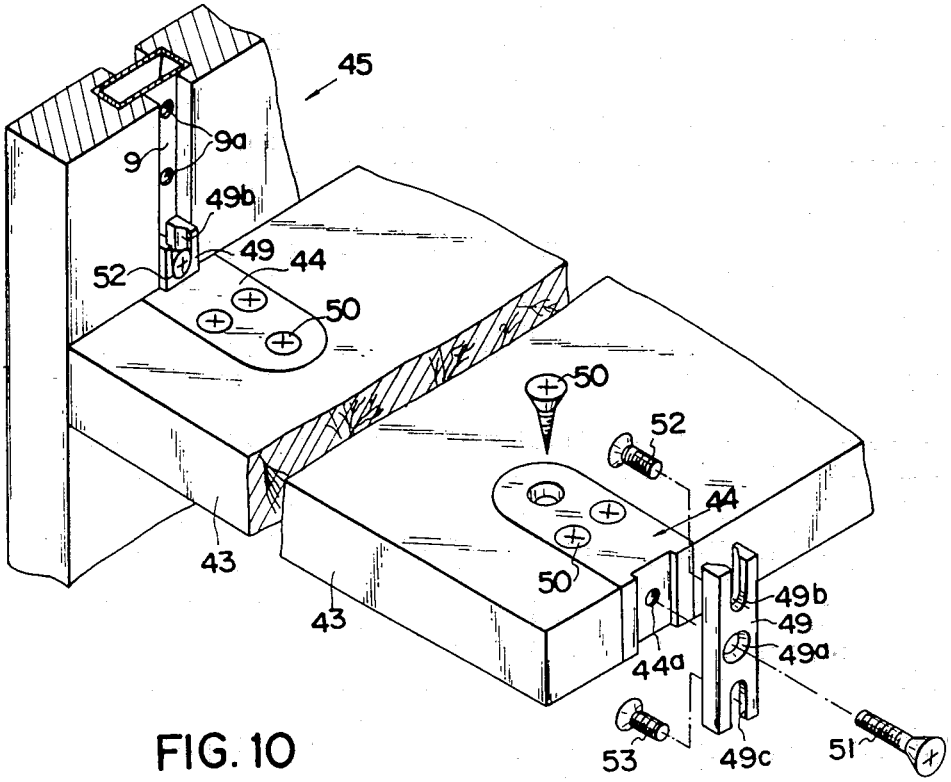
FIG. 9 is a perspective view showing, partly in section, an essential portion of a prefabricated furniture according to a third embodiment of this invention, corresponding to FIG. 3.
Figure 10:
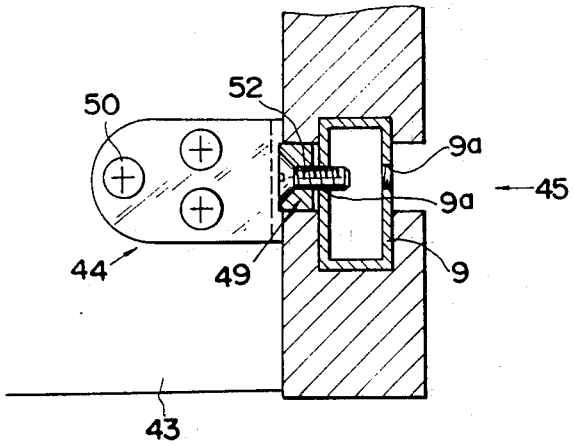
FIG. 10 is a cross-sectional view showing a holder and an attachment for holding a horizontal panel assembly in relation to a vertical panel assembly as shown in FIG. 9.
Figure 11:
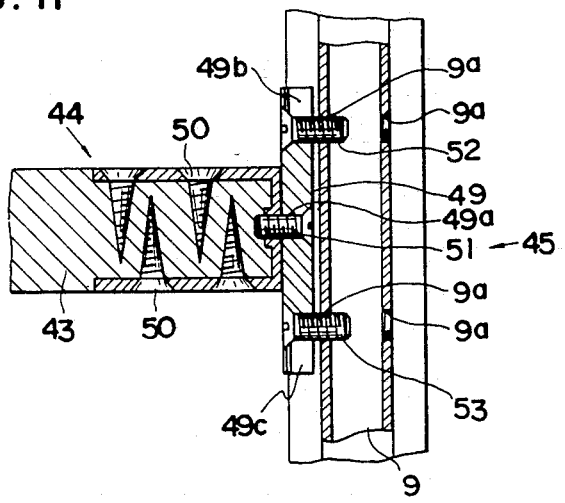
FIG. 11 is a vertical sectional view of the holder and attachment shown in FIG. 9.
Figure 12:
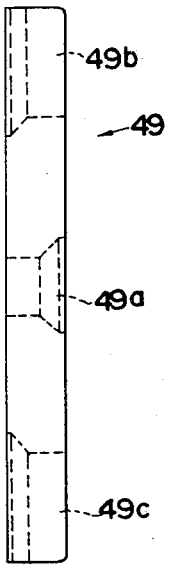
FIG. 12 is a side view of the attachment shown in FIG. 9.
Figure 13:
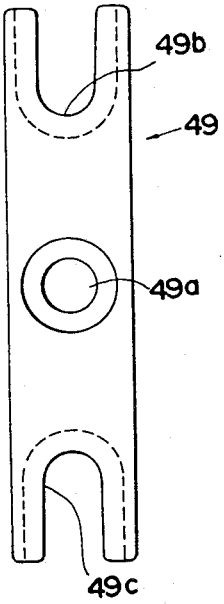
FIG. 13 is a front view of the attachment shown in FIG. 9.
Figure 14:
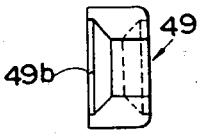
FIG. 14 is a plan view of the attachment shown in FIG. 9.

FIG. 8 shows a second embodiment of this invention which is substantially the same as the first embodiment of FIGS. 1 to 7 except the configuration of a vertical panel assembly 35 which is positioned at the wall 27.

The vertical panel assembly 35 is composed of a central panel 35*a*, a front panel 35*b* and a rear panel 35*c* which are joined by two joint tubes 9. The front and rear panels 35*b*, 35*c* have an extending portion 36 having a L-shaped cross-section an end of which contacts the wall 27.

Embodiment 3

FIGS. 9 to 14 show a third embodiment of this invention which is substantially the same as the first embodiment except a joint portion of a horizontal board 43 to a vertical panel assembly 45.

A holder 44 is fixed to each end of a horizontal board 43 by means of wood screws 50. The holder 44 has a female screw 44*a* at its side.

Figure 3:
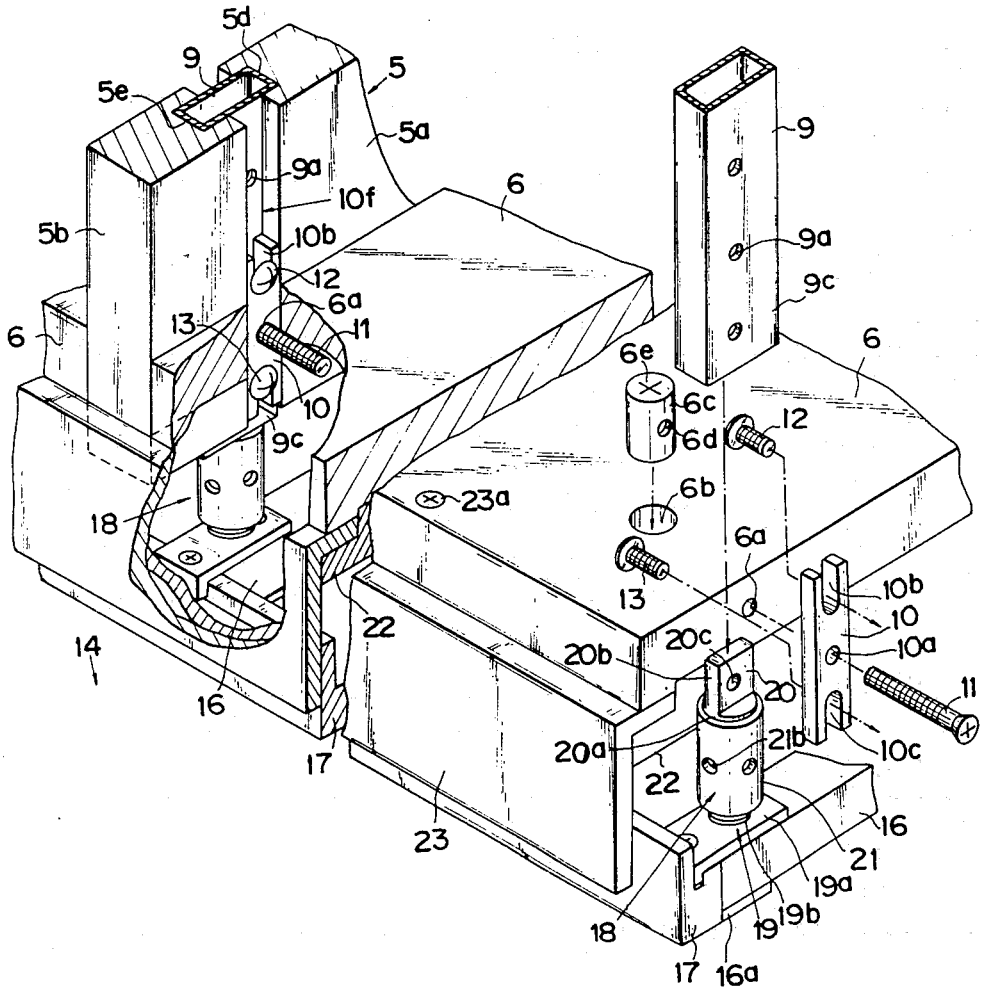
FIG. 3 is a perspective view, in a partially exploded condition, showing an essential portion of the prefabricated furniture shown in FIG. 1.
Figure 4:
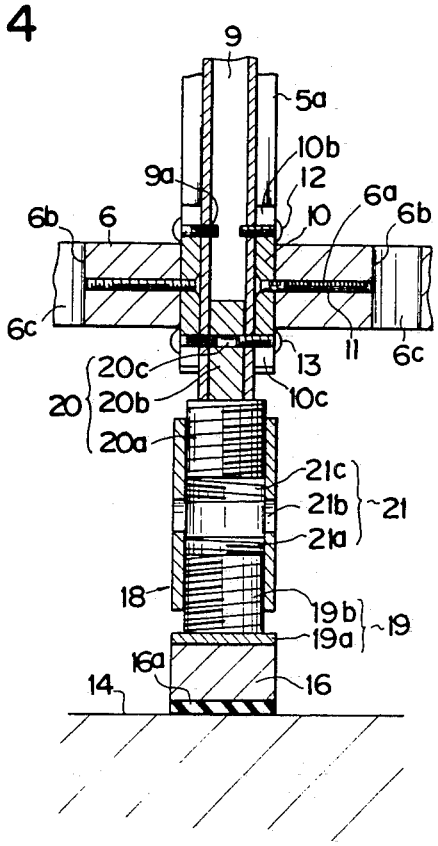
FIG. 4 is a vertical sectional view showing a lower portion of the furniture shown in FIG. 1.

An attachment 49, which is similar to the attachment 10 shown in FIG. 3, has a hole 49*a* and a pair of U-shaped openings 49*b*, 49*c* at its upper and lower ends.

A screw 51 passes through the hole 49*a* of the attachment 49 and engages the female screw 44*a* of the holder 44 so that the attachment 49 is fixed to the holder 44. Screws 52, 53 pass the openings 49*b*, 49*c* of the attachment 49 and engage the female screws 9*a* of the joint tube 9 so that the horizontal board 43 is secured to the vertical panel assembly 45 by way of the attachment 49.

Embodiment 4

Figure 15:
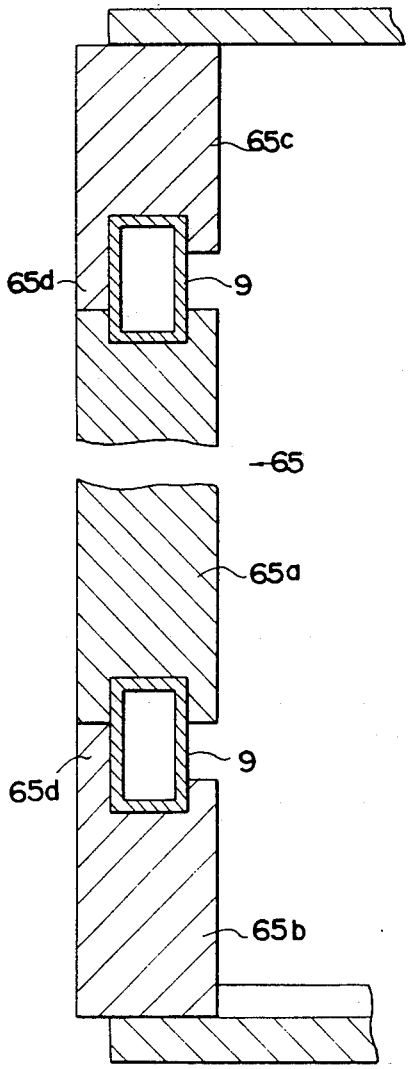
FIG. 15 is an enlarged cross-sectional view, partly cut away, showing a portion of a prefabricated furniture according to a fourth embodiment of this invention.

In FIG. 15, a vertical panel assembly 65 includes two joint tubes 9 and three panels 65*a*, 65*b*, 65*c* which are joined in such a manner as in the furniture of FIGS. 1 to 7 except an extension 65*d*. The front and rear panels 65*b*, 65*c* have such an extension 65*d* so as to cover the joint tubes 9 whereby the joint tubes 9 cannot be seen from the outer side of the furniture.

Figure 16:
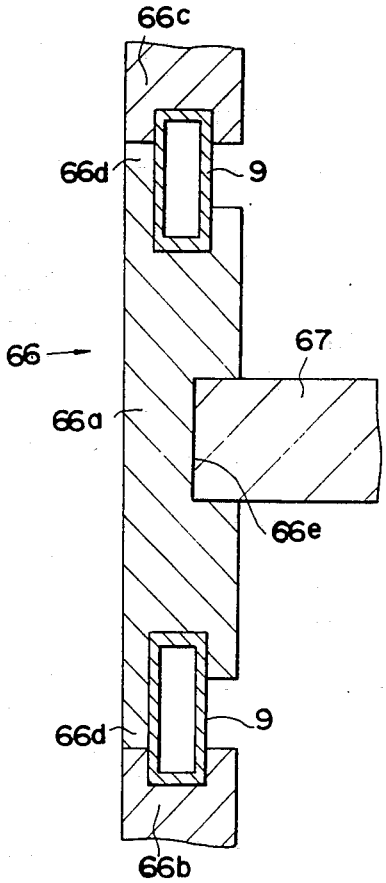
FIG. 16 illustrates a modified vertical panel assembly, corresponding to FIG. 15.

In FIG. 16, a vertical panel assembly 66 includes two joint tubes 9 and three panels 66*a*, 66*b*, 66*c*. The central panel 66*a* has two extensions 66*d* for the purpose of covering the joint tubes 9 and a vertical groove 66*e* to which a partition 67 is joined.

Embodiment 5

Figure 17:
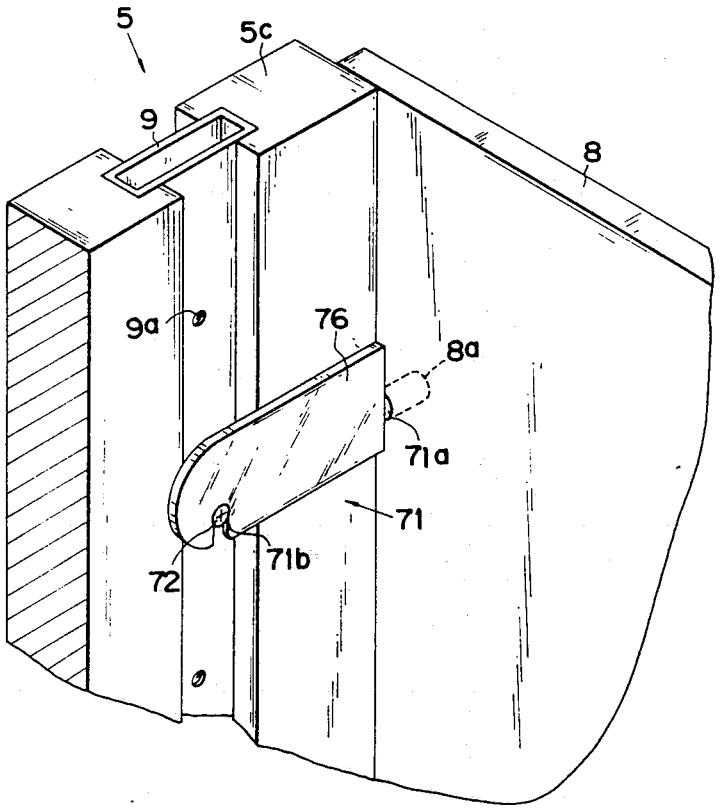
FIG. 17 is a perspective view showing a corner of a prefabricated furniture according to a fifth embodiment of this invention.

In FIG. 17, the furniture of FIGS. 1 to 7 is modified in respect to means for attaching the back plate 8. The back plate 8 is attached to the rear panel 5*c* of the vertical panel assembly 5 by means of a hook 71. A male screw 71*a* of the hook 71 engages a female screw 8*a* of the back plate 8. A slit 71*b* of the hook 71 engages a screw 72 fixed in one of the female screws 9*a* of the joint tube 9.

Embodiment 6

Figure 18:
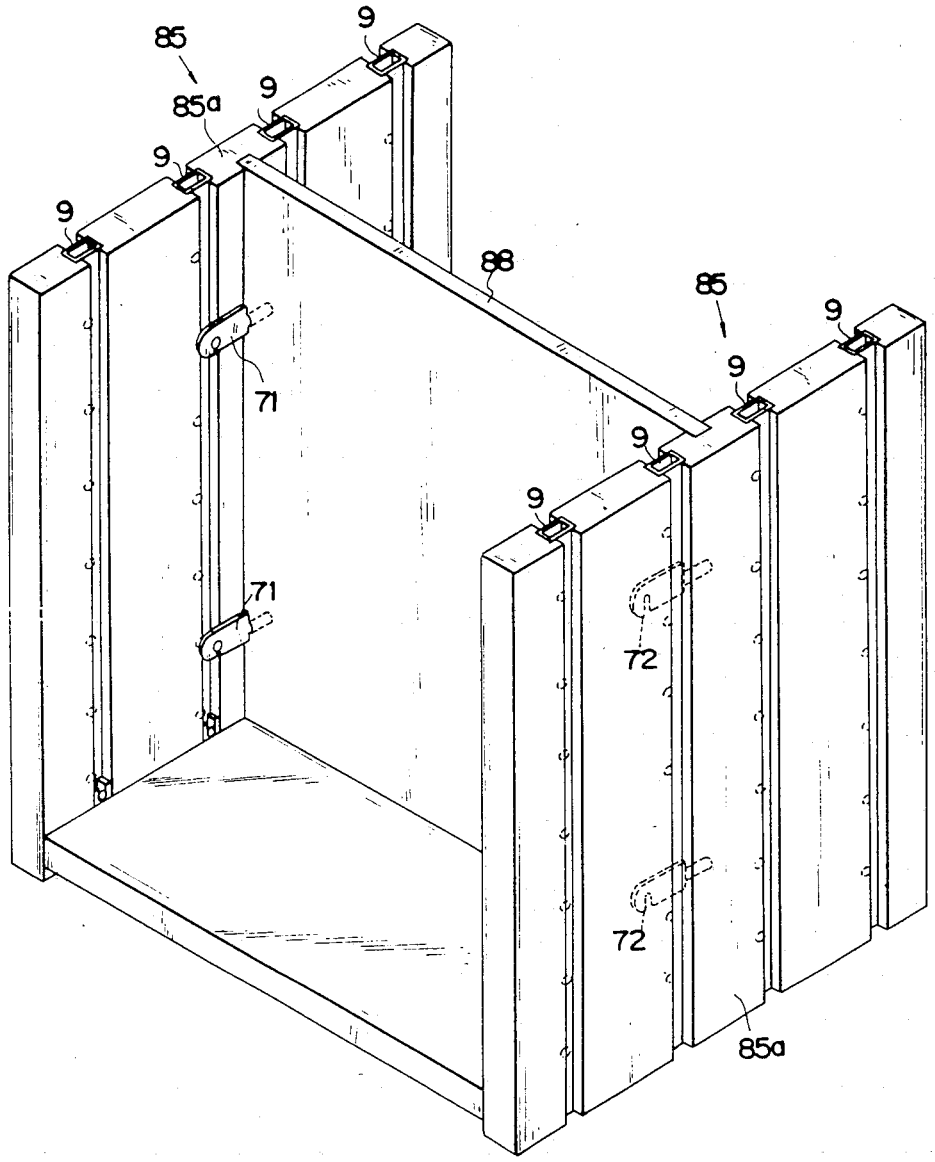
FIG. 18 is a perspective view showing a portion of a prefabricated furniture according to a sixth embodiment of this invention.

In FIG. 18, the furniture of FIGS. 1 to 7 is modified only in respect to two vertical panel assemblies 85 each including four joint tubes 9 and five panels. A partition 88 is placed between the adjacent central panels 85*a* by means of the four hooks 71 shown in FIG. 17.

Modifications

This invention may be embodied in still other ways without departing from the spirit thereof. The illustrated embodiments may be partly exchanged.

If desired, only one part of the furniture may be exchanged. For instance, only the front panels of the vertical panel assemblies 5 can be exchanged into new ones while the other parts of the furniture are substantially not removed or disassembled.

The adjustor may be attached only to a lower end of the joint tube while an upper end of the joint tube may be supported by a certain support member (not shown).

I claim:

1. A prefabricated furniture for use in a room having a floor and a ceiling, comprising:

a plurality of vertical panel assemblies being vertically arranged in parallel to each other at predetermined intervals between the floor and the ceiling;

each vertical panel assembly comprising first and second joint tubes having upper and lower ends, a central panel, and first and second side panels, wherein the first joint tube connects said central panel to the first side panel and the second joint tube connects said central panel to the second side panel;

each joint tube having opposed edge portions cooperating with said side panels and a plurality of female screws in the edge portion at predetermined intervals;

said central panel having two grooves, oppositely situated along the edges of said central panel, cooperating with said joint tubes, and said side panels each having a groove cooperating with said joint tubes;

a plurality of horizontal panel assemblies each having a horizontal board;

a plurality of attachments, each having first and second ends, secured to opposite ends of said horizontal boards for attaching the horizontal panel assemblies in a fixed condition between adjacent vertical panel assemblies, wherein each of said attachments having a U-shaped opening at each end of the attachment, one of which is open in a downward direction and the other of which is open in an upward direction, and a hole, whereby a first male screw passes through said hole to fix said attachment to said horizontal boards, and a plurality of second male screws, one of said second male screws passing through said upwardly open U-shaped opening and another of said second male screws passing through said downwardly open U-shaped opening to engage selected female screws of said joint tube to fix said attachment to said joint tube; and, a plurality of adjustors attached to both the upper and lower ends of each of said joint tubes for vertically adjusting the vertical panel assemblies so as to fix the vertical panel assemblies in a desired position between the floor and the ceiling, each adjustor having a first member having a male screw, a second member having a male screw, and an enlongate third member having a coaxial pair of female screws, said pair of female screws having a first thread in clockwise thread direction, the second of said screws having a thread in a counter-clockwise direction such that said first thread engages said male screw of said first member and said male screw of said second member so that the third member can be turned to adjust the distance between the first member and the second member.

2. A prefabricated furniture as defined in claim 1, wherein the joint tubes are formed substantially rectangular in cross-section and made of a metal.

3. A prefabricated furniture as defined in claim 1, further comprising a resilient member placed between a wall and the vertical panel assembly adjacent thereto for light and noise insulating purposes.

4. A prefabricated furniture as defined in claim 1, wherein a front panel of the vertical panel assembly adjacent to a wall has an extension an end of which contacts the wall for light and noise insulating purposes.

5. A prefabricated furniture as defined in claim 1, wherein the horizontal board has at both ends thereof plural holders to which the attachments are fixed by means of screws.

6. A prefabricated furniture as defined in claim 1, wherein the adjacent panels of the vertical panel assembly define two vertical grooves between opposite edges thereof at both sides of the joint tube in which the attachments are placed.

7. A prefabricated furniture as defined in claim 1, wherein the adjacent panels of the vertical panel assembly contact to each other at an outer side of the joint tube and define a vertical groove between opposite edges thereof at an inner side of the joint tube in which the attachments are placed.

8. A prefabricated furniture as defined in claim 1, wherein the furniture is placed in the room so as to partition it into two sections.

9. A prefabricated furniture as defined in claim 1, further comprising a back plate fixed to the vertical panel assemblies.

10. A prefabricated furniture as defined in claim 9, wherein the back plate partitions the room into two sections.

11. A prefabricated furniture as defined in claim 1, further comprising a partition placed between the vertical panel assemblies.

12. A prefabricated furniture as defined in claim 10, wherein the back plate is detachably fixed by plural hooks.

13. A prefabricated furniture as defined in claim 11, wherein the partitions are detachably fixed by plural hooks.

* * * * *